United States Patent [19]

Steers et al.

[11] Patent Number: 4,995,244

[45] Date of Patent: Feb. 26, 1991

[54] REFRIGERATING MACHINE COMPRISING AN END-OF-DEFROSTING DETECTOR

[75] Inventors: Michel Steers, La Quelle En Brie; Jean-Pierre Hazan, Sucy-En-Brie; Gilles Delmas, Epinay-Sous-Senart, all of France

[73] Assignee: U.S. Philips Corp., New York, N.Y.

[21] Appl. No.: 446,504

[22] Filed: Dec. 5, 1989

[30] Foreign Application Priority Data

Dec. 30, 1988 [FR] France ..... 88 17494

[51] Int. Cl.[5] ..... F25D 21/08

[52] U.S. Cl. ..... 62/155; 62/276; 62/288; 340/608

[58] Field of Search ..... 62/125, 126, 128, 129, 62/151, 152, 155, 156, 140, 188, 189, 285, 288, 289, 291; 340/606, 608, 609

[56] References Cited

U.S. PATENT DOCUMENTS

| | | | |
|---|---|---|---|
| 3,065,608 | 11/1962 | Arzberger | 62/285 X |
| 3,280,577 | 10/1966 | Kobayashi et al. | 62/126 |
| 4,570,639 | 2/1986 | Miodownik | 340/608 X |
| 4,631,529 | 12/1986 | Zoitz | 340/606 X |

FOREIGN PATENT DOCUMENTS

| | | |
|---|---|---|
| 2609789 | 7/1988 | France . |
| 1546071 | 5/1979 | United Kingdom . |

*Primary Examiner*—Harry B. Tanner

*Attorney, Agent, or Firm*—Ernestine C. Bartlett

[57] ABSTRACT

A refrigerating machine (10) of the refrigerator or freezer type comprises a device (33) for defrosting cold parts to transform the ice into water to be discharged. It has an end-of-defrosting detector (20) comprising:

(1) a reservoir (24) which receives the water to be discharged, one of the branches (23) of a siphon (21) extending into said reservoir in order to drain the reservoir when the water reaches the level required for activation of the siphon, the other branch (22) being situated externally of the reservoir, (2) a light barrier (27, 28), comprising a light source and a light receiver arranged around the other branch (22) of the siphon in such a way that the light beam of the light barrier is interrupted by the passage of water through said other branch while defrosting is in progress, and (3) a electric circuit (30, 31, 32, 34) which stops defrosting when the light beam is not interrupted for a predetermined time.

7 Claims, 2 Drawing Sheets

REFRIGERATING MACHINE COMPRISING AN END-OF-DEFROSTING DETECTOR

FIELD OF THE INVENTION

The invention relates to a refrigerating machine of the refrigerator or freezer type, comprising a device for defrosting cold parts to transform the ice into water to be discharged.

BACKGROUND OF THE INVENTION

An advantage of cold-ventilation refrigerators/freezers is the absence of frost in the refrigerating compartments. Nevertheless, frost is formed on the coldest spot of the freezer, i.e. on the evaporator fins. If freezer or refrigerator doors are opened frequently so much frost will be formed on the evaporator that it obstructs the fins, thereby reducing the refrigeration efficiency and impeding the circulation of air. Therefore, the evaporator must be defrosted periodically.

It is customary to effect defrosting by means of a resistive heating element which is in contact with the evaporator. By means of a timer this element is energized at regular intervals (generally for half an hour every 8 hours). In order to avoid an excessive temperature rise in the freezing compartment said element should not be energized for too long a time and should be disconnected as soon as defrosting is completed.

The problem which then arises is that the instant at which defrosting is finished should be detected in order to stop the defrosting process.

A solution which may be adopted is to detect the flow of water in the discharge pipe, for example by measuring the electrical resistance between two electrodes as described in the document FR 2,609,789. However, these measurements are susceptible to errors and are not reliable enough to enable the end of the defrosting operation to be determined correctly.

SUMMARY OF THE INVENTION

According to the invention this problem is solved in that it comprises an end-of-defrosting detector comprising:

(1) a reservoir which receives the water to be discharged, one of the branches of a siphon extending into said reservoir in order to drain the reservoir when the water reaches the level required for activation of the siphon, the other branch being situated externally of the reservoir, (2) a light barrier, comprising a light source and a light receiver arranged around the other branch of the siphon in such a way that the light beam of the light barrier is interrupted by the passage of water through said other branch while defrosting is in progress, and (3) an electric circuit which processes the electric signal supplied by the light barrier to detect the end of defrosting when the light beam is not interrupted for a predetermined time, in order to render the defrosting element inoperative.

During defrosting of the refrigerating machine the ice turns into water. This water is discharged by a pipe at the rear of the refrigerator and is collected in a main reservoir arranged underneath the refrigerating unit. The discharged water is evaporated under the influence of the heat produced by this unit.

In accordance with the invention the end-of-defrosting detector can be arranged between said discharge pipe and the main reservoir. The water flows through the discharge pipe into the reservoir of the detector which has a capacity of, for example, a few cubic centimeters. The reservoir of the detector is connected to the main reservoir by means of the siphon. During the defrosting process the water flows into the reservoir of the detector and as soon as the level is high enough to activate the siphon the water flows abruptly into the main reservoir until the siphon is no longer active.

The defrosting process is thus characterized by a cycle in which the detector reservoir is successively filled and drained. This cycle is detected with the aid of the light barrier by means of a signal which triggers a monostable, which remains in this state for a time which is slightly longer than the time interval between two discharges of the detector reservoir. The pulse corresponding to the second discharge serves to retrigger the monostable for a similar time interval.

When defrosting is completed there is no longer enough water to refill the detector reservoir. Consequently, the light barrier no longer supplies any signals to trigger the monostable. Therefore, it is reset to its initial state after its active period.

To start the defrosting process the other input of the RS multivibrator is controlled by a signal which may be supplied by a timer if the defrosting operations are preprogrammed. It may also be supplied by a frost detector which detects that a defrosting process should be started.

Thus, the electric signal from the light barrier triggers a monostable each time that the siphon becomes active, which monostable activates one of the inputs of an RS multivibrator to cause the output of this multivibrator to continue the defrosting process, the active period T2 of the monostable being longer than the release period T1 of the siphon, the RS multivibrator being deactivated when the monostable is deactivated, and the defrosting cycle being started by controlling the other input of the RS multivibrator either by means of a timer or an external signal.

BRIEF DESCRIPTION OF THE DRAWING

The invention will now be described in more detail, by way of non-limitative example, with reference to the accompanying drawings in which

FIG. 1 is a diagram of a refrigerating machine 10 comprising a housing 11 in which a compressor 12 delivers cold to an evaporator 13. The evaporator is defrosted by means of a resistive heating element 33. The detector 20 in accordance with the invention is arranged underneath the evaporator 13 and is adapted to receive the water produced by defrosting. This detector is shown in FIG. 2. It comprises a siphon 21 having a branch 22 which extends into the main reservoir 25, which serves for receiving the defrosting water of the refrigerating machine. The small reservoir of the detector 24 receives its water from the evaporator via the pipe 26. Around the branch 22 outside the small reservoir 24 a light barrier is arranged which comprises a light source 27 (for example a light-emitting diode) and a light receiver 28 (for example a phototransistor). During defrosting the water is collected in the small reservoir 24 until the highest level of the siphon is reached, thereby activating the siphon to drain the small reservoir 24. This process is repeated until the evaporator is defrosted completely.

Figure 3:
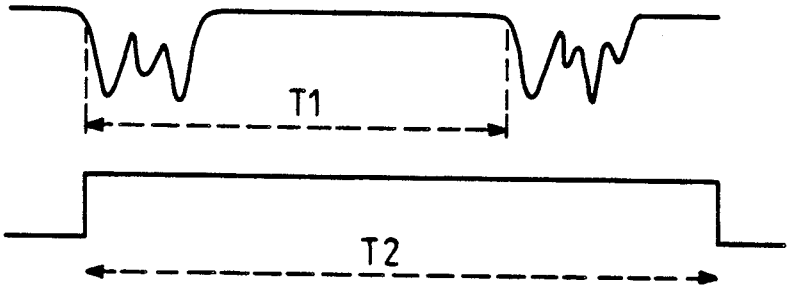
FIG. 3 shows the electric signals supplied by the light barrier and by the monostable.

When there is no water flow at the location of the light barrier the detector receives a luminous flux. When the water flows the luminous flux is interrupted. The time constant of the siphon results in the interruptions of the luminous flux being spaced at intervals T1 (FIG. 3).

Figure 1:
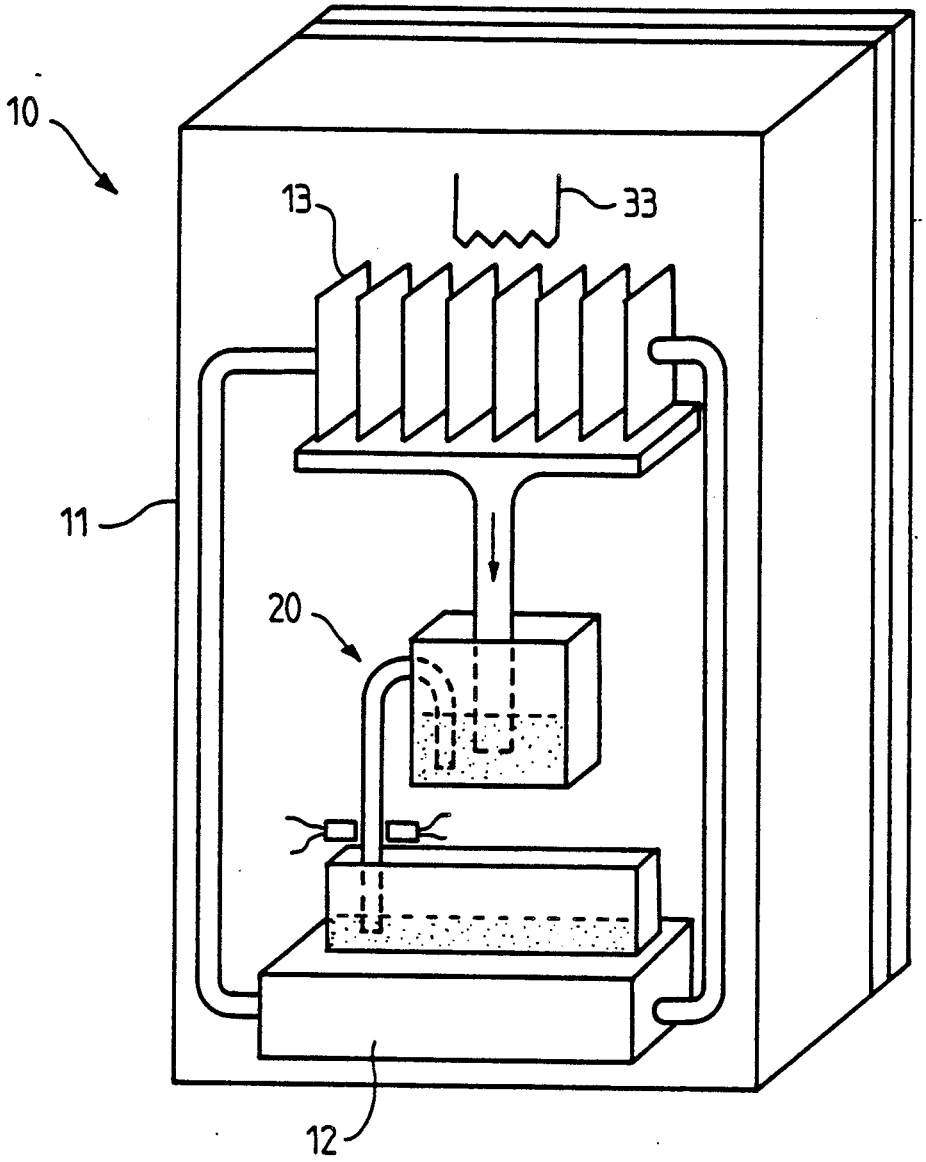
FIG. 1 is a diagram showing a refrigerating machine comprising an end-of-defrosting detector.
Figure 2:
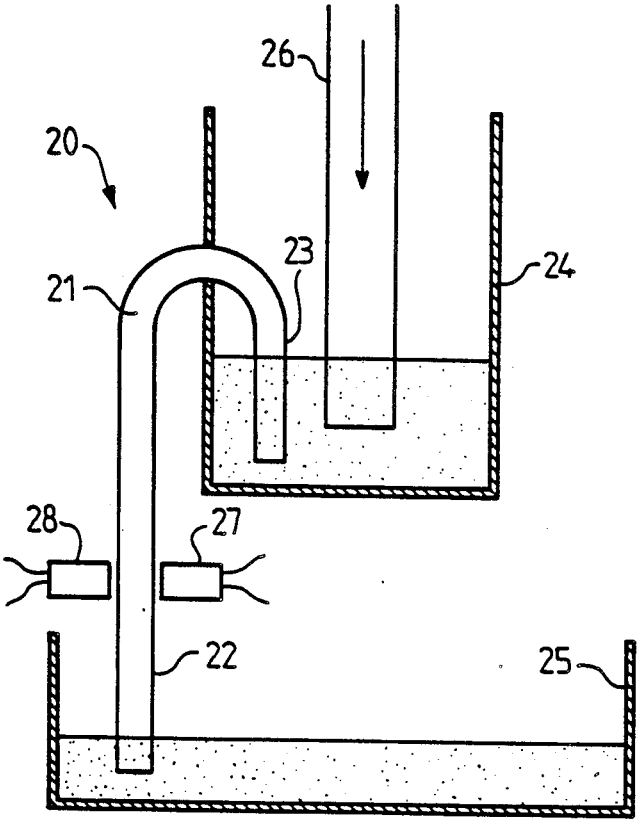
FIG. 2 is a diagram showing the reservoir, the siphon and the light barrier of the end-of-defrosting detector in accordance with the invention.
Figure 4:
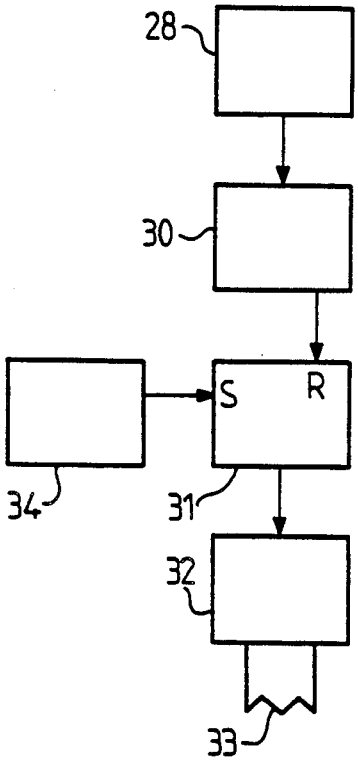
FIG. 4 is an electric circuit diagram of the detector.

In order to detect the end of defrosting, i.e. the end of the cycle of interruption and transmission of the luminous flux, the electric circuit shown in FIG. 4 is used.

The circuit comprises the detector 28, the beginning of the signal which it detects being used to retrigger a monostable 30. This monostable has an active period T1 as indicated in FIG. 3. The output of the monostable influences an R-input of an RS multivibrator 31 and activates the output of the multivibrator 31 to turn on the power supply 32 of the resistive element 33, which serves for heating the evaporator for the purpose of defrosting.

The element 33 is energized during the cycles performed by the siphon. When defrosting is completed the monostable T2 is no longer retriggered and changes over to turn off the power supply to the resistive element 33. The defrosting cycle is now terminated.

In order to start a defrosting cycle the RS multivibrator is retriggered via its other input S. This can be effected by means of a device 34, which may be a timer programmed for regular cycles or by means of a frost detector which measures the ice thickness to detect that a defrosting operation must be carried out.

The end-of-defrosting detector in accordance with the invention can be used in a refrigerator, in a freezer or in any refrigerating machine which requires defrosting.

We claim:

1. A refrigerating machine of the refrigerator or freezer type comprising a device for defrosting cold parts to transform the ice into water to be discharged characterized in that it comprises an end-of-defrosting detector comprising:

(1) a reservoir which receives the water to be discharged, one of the branches of a siphon extending into said reservoir in order to drain the reservoir when the water reaches the level required for activation of the siphon, the other branch being situated externally of the reservoir, (2) a light barrier, comprising a light source and a light receiver arranged around the other branch of the siphon in such a way that a light beam of the light barrier is interrupted by the passage of water through said other branch while defrosting is in progress, and (3) an electric circuit which processes an electric signal supplied by the light barrier to detect the end of defrosting when the light beam is not interrupted for a predetermined time, said detector being effective to render the defrosting element inoperative when said end of defrosting is detected.

2. A refrigerating machine as claimed in claim 1, wherein upon each activation of the siphon the electric signal from the light barrier triggers a monostable which controls one of the inputs of an RS multivibrator to cause the output of the RS multivibrator to continue the defrosting process, the active period T2 of the monostable being longer than the release period T1 of the siphon, the RS multivibrator being deactivated when the monostable is deactivated, and a defrosting cycle being started by controlling the other input of the RS multivibrator by means of a timer.

3. A refrigerating machine as claimed in claim 1, wherein the external signal is a supplied by frost detector.

4. A refrigerating machine as claimed in claim 2 wherein the defrosting cycle is started by controlling the other input of the RS multivibrator by means of an external signal.

5. A refrigerating machine of the refrigerator or freezer type comprising a device for defrosting parts to transform ice into water to be discharged which comprises an end-of-defrosting detector having (1) a reservoir which receives the water to be discharged, one of the branches of a siphon extending into said reservoir in order to drain the reservoir when the water reaches the level required for activation of the siphon, the other branch being situated externally of the reservoir, (2) a light barrier comprising a light source and a light receiver arranged around the other branch of the siphon in such a way that a light beam of the light barrier is interrupted by the passage of water through said other branch while defrosting is in progress, and (3) an electric circuit which processes an electric signal supplied by the light barrier to detect the end of defrosting when the light beam is not interrupted for a predetermined time, said detector receiving a signal from the light barrier upon activation of the siphon, said activated siphon being effective to trigger a monostable which influences the R-input of an RS multivibrator to activate the power supply of a resistive element to heat an evaporator for defrosting, said resistive element being energized during cycles performed by the siphon and when the S-input of the RS multivibrator is triggered and being deenergized by deactivation of the monostable when no cycles of the siphon are performed for a predetermined time indicating that a defrosting cycle is completed;

a defrosting cycle being started by triggering the S-input of the RS multivibrator.

6. A refrigerating machine as claimed in claim 5 wherein the multivibrator is retriggered via the S-input by a timer programmed for regular cycles.

7. A refrigerating machine as claimed in claim 5 wherein the multivibrator is retriggered via the S-input by a frost detector.

* * * * *